US006256945B1

(12) United States Patent
Yates et al.

(10) Patent No.: US 6,256,945 B1
(45) Date of Patent: Jul. 10, 2001

(54) FLOOR FOR A REFRIGERATION SYSTEM

(75) Inventors: Gaylon Yates, Parsons, TN (US); Loren Rasmusson, River Falls, WI (US)

(73) Assignee: Manitowoc Foodservice Group, Inc., Sparks, NV (US)

( * ) Notice: Subject to any disclaimer, the term of this patent is extended or adjusted under 35 U.S.C. 154(b) by 0 days.

(21) Appl. No.: 09/334,053

(22) Filed: Jun. 15, 1999

(51) Int. Cl.[7] ..... F25D 13/00; E04C 2/36

(52) U.S. Cl. ..... 52/177; 52/309.5; 52/309.8; 52/506.02; 52/506.04; 52/793.1; 52/794.1; 62/440

(58) Field of Search ..... 52/309.5, 309.8, 52/506.02, 506.04, 177, 793.1, 794.1; 62/440

(56) References Cited

U.S. PATENT DOCUMENTS 3,472,728 * 10/1969 Hitch ..... 52/794.1 X
4,297,154 * 10/1981 Keller ..... 52/309.5 X
5,894,044 * 4/1999 Norcom et al. ..... 52/793.1 X
6,061,993 * 5/2000 Bendixen et al. ..... 52/793.1 X

OTHER PUBLICATIONS

Drawing of Kolpak floor, prior to 1998.

* cited by examiner

*Primary Examiner*—Christopher T. Kent
(74) *Attorney, Agent, or Firm*—Brinks Hofer Gilson & Lione

(57) ABSTRACT

A walk-in refrigerator/freezer having a plurality of walls and a ceiling is provided. The refrigerator/freezer also includes a door and a floor. The floor includes a top wear surface, and a metal support grid beneath the top wear surface. The metal support grid has a plurality of apertures. An insulation material is located beneath the metal support grid. The insulation material passes through the apertures of the metal support grid and bonds to the wear surface.

20 Claims, 2 Drawing Sheets

FLOOR FOR A REFRIGERATION SYSTEM

FIELD OF THE INVENTION

The invention relates generally to the field of walk-in refrigerator or freezer units. More specifically, the present invention relates to an improved floor structure for use with a walk-in refrigerator or freezer unit.

BACKGROUND OF THE INVENTION

Walk-in refrigerator or freezer units are large, enclosed spaces used for storage. Perishable items such as food materials or flowers are commonly stored within these refrigerators or freezers. In operation, a user typically to opens the insulated door and walks within the storage area of the refrigerator or freezer in order to add or remove stored items. The floor of the refrigerator or freezer is typically constructed with a top wear surface. The wear surface is commonly formed from a smooth aluminum. This surface often needs to be reinforced when used with heavy loads. In particular, the wear surface should be reinforced when used with a heavy cart. Materials such as plywood can be used to reinforce the wear surface.

There are certain disadvantages, however, with the use of previous walk-in refrigerator or freezer floor constructions. While the use of a plywood reinforcement material is advantageous because of the additional support that it provides, it can become detached from the wear surface. When the plywood support material becomes detached, a user walking on the wear surface will feel like they are walking on a loose metal structure. This can be distracting, uncomfortable and cause metal fatigue.

Accordingly, there is a need for an improved floor for use with a walk-in refrigerator or freezer that securely bonds a wear surface to a support surface while being economical and capable of easy construction.

SUMMARY OF THE INVENTION

A walk-in refrigerator/freezer has been invented that overcomes the problems of previous constructions. In particular, a walk-in refrigerator/freezer floor has been invented that includes a wear surface that is properly supported by a support surface while being securely attached thereto. The floor of the present invention can also be economically and easily constructed A walk-in refrigerator/freezer having a plurality of walls and a ceiling is provided. The refrigerator/freezer also includes a door and a floor. The floor includes a top wear surface, and a metal support grid beneath the top wear surface. The metal support grid has a plurality of apertures. An insulation material is located beneath the metal support grid. The insulation material passes through the apertures of the metal support grid and bonds to the wear surface.

According to another aspect of the invention, a floor for use with a refrigeration unit is provided. The floor includes a top wear surface and a support material beneath the wear surface. The support material has a plurality of apertures. A bonding material passes through the apertures and bonds the wear surface to the support material.

According to another aspect of the invention, a walk-in refrigerator/freezer is provided. The walk-in refrigerator/freezer includes a plurality of insulated walls, an insulated ceiling, and an insulated door. A floor having a top wear surface and a metal support grid beneath the top wear surface is also provided. The floor includes a plurality of apertures and an insulation layer beneath the metal support grid. The insulation layer is formed from a foam material passing through the apertures of the metal grid and bonding to the wear surface.

As used herein, the "refrigerator/freezer" or "refrigeration system" is intended to be interpreted broadly and include either a refrigerator or a freezer system.

The advantages of the present invention will be best understood in view of the attached drawings and the following description.

DETAILED DESCRIPTION OF THE DRAWINGS AND PREFERRED EMBODIMENTS OF THE INVENTION

Figure 1:
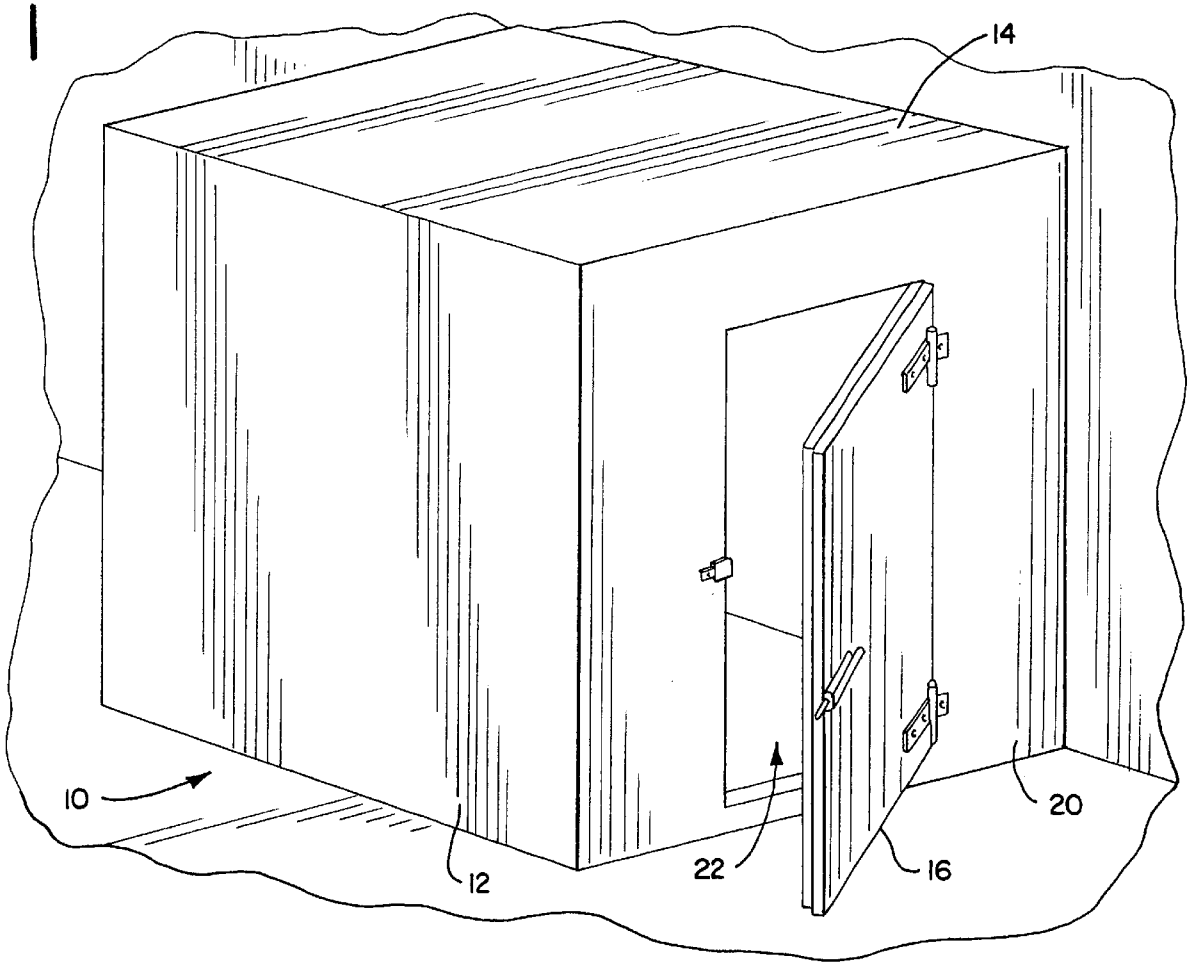
FIG. 1 is a perspective view of a refrigerator/freezer in accordance with a first preferred embodiment of the invention.

FIG. 1 illustrates a walk-in refrigerator/freezer 10 constructed in accordance with a preferred embodiment. The walk-in refrigerator/freezer 10 includes a plurality of side walls 12 and a ceiling 14. A door 16 is shown attached to the front wall 20. A floor 22 is also illustrated. The side walls 12, the ceiling 14, the door 16, the front wall 20 and the floor 22 are formed, in part, from an insulation material such as polyurethane with an outer surface formed from galvanized steel.

In a preferred embodiment, the refrigerator/freezer 10 is constructed having a rectangular configuration with walls having a length of approximately 8' and height of approximately 8½'. However, the present invention may be implemented in refrigerator/freezer configurations having a wide variety of shapes and sizes. It is intended that the refrigerator/freezer 10 be used with a conventional refrigeration systems such as that produced by Kolpak of Parsons, Tenn.

Figure 2:
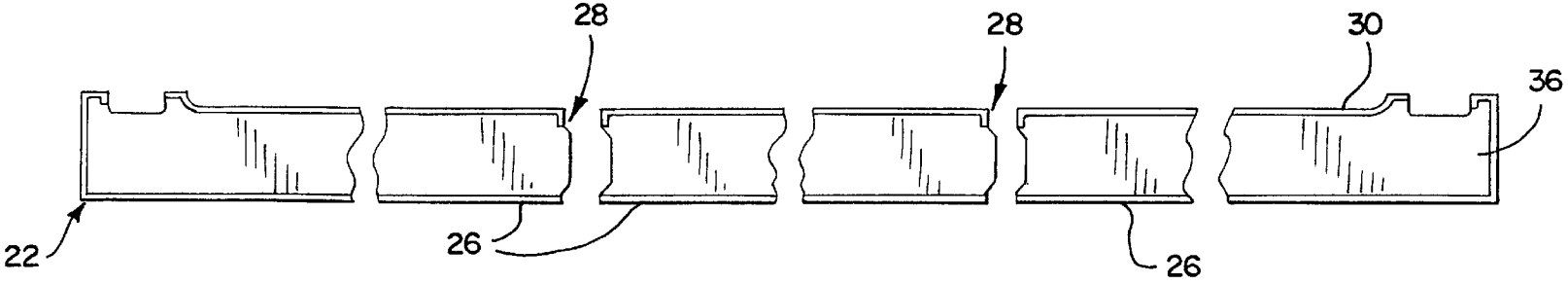
FIG. 2 is a cross-section of the floor as illustrated in FIG. 1.
Figure 3:
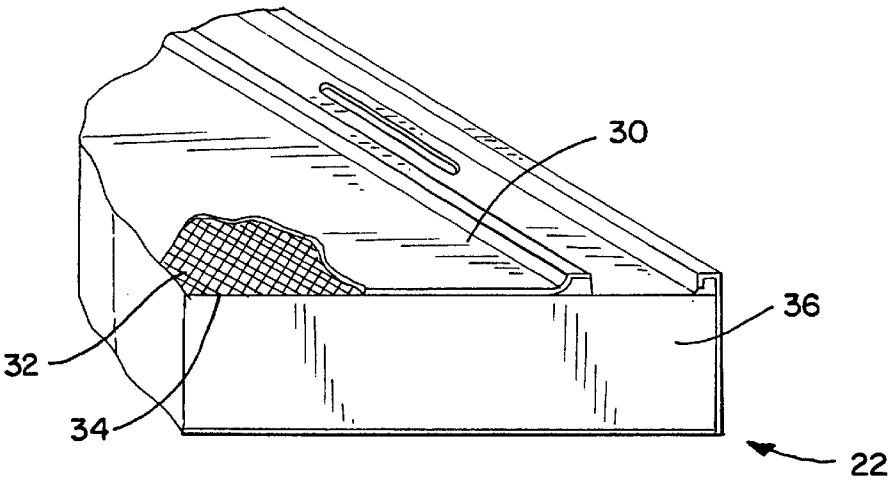
FIG. 3 is a cross-section and partially broken away view of the floor as illustrated in FIGS. 1–2.

FIGS. 2–3 best illustrates the construction of the floor 22 in accordance with the preferred embodiment. As illustrated in FIG. 2, the floor 22 is formed from a plurality of pieces 26. The pieces 26 are connected at the joints 28 using camlocks. With reference to FIG. 3, the floor 22 includes a top wear surface 30. The top wear surface 30 is formed from a durable material such as aluminum. In the preferred embodiment, the wear surface is constructed using a smooth aluminum having a thickness of 0.10". In the alternative, a 16 gauge stainless steel material may also be used.

A heavy-duty expanded metal support grid 32 is located beneath the wear surface 30. The support grid provides additional support for the wear surface 30 when used with heavy loads such a heavy carts. However, alternative floor structures such as a concrete floor are necessary for use with particularly heavy loads such a forklift. The support grid 32 includes a plurality of apertures 34. Materials such as a 14 gauge steel are preferably used to form the support grid 32. An insulation material 36 is located beneath the support grid 32. The insulation material 36 is preferably constructed from a foamed-in-place polyurethane. In a preferred embodiment, the polyurethane has a 2.2 pound density with a K-factor of 0.121 and a U-factor of 0.30. In addition, the preferred polyurethane has an R value of 33. The insulation material

36 is preferably foamed-in-place such that the foam flows through apertures 34 of the support grid 32 and thereby bonds to the wear surface 30 as well. As a result, the wear surface 30 is fixedly secured to the insulation material 36 and the support grid 32.

Variations and modifications of the embodiments disclosed in this specification may be made without departing from scope and spirit of the invention. For example, the types of materials used or the configuration of the metal support grid may be modified without departing from the present invention. The aforementioned description is intended to be illustrative rather than limiting and it is understood that the scope of the invention is set forth by the following claims.

I claim:

1. A walk-in refrigerator comprising:

a) a plurality of walls and a ceiling;

b) a door; and c) a floor having a top wear surface, a metal support grid beneath the top wear surface having a plurality of apertures and an insulation material beneath the metal support grid, the insulation material passing through the apertures of the metal support grid and bonding to the wear surface.

2. The walk-in refrigerator of claim 1 wherein the wear surface is formed from aluminum.

3. The walk-in refrigerator of claim 2 wherein the metal grid is formed from steel.

4. The walk-in refrigerator of claim 3 wherein the metal grid is formed from a flattened and expanded material.

5. The walk-in refrigerator of claim 4 wherein the insulation material is formed from a foamed-in-place material.

6. The walk-in refrigerator of claim 5 wherein the insulation material is polyurethane.

7. A floor for use with a refrigeration unit comprising:

a) a top wear surface;

b) a support material beneath the wear surface having a plurality of apertures; and c) a bonding material passing through the apertures and bonding the wear surface to the support material.

8. The floor of claim 7 wherein the bonding material forms an insulation layer.

9. The floor of claim 8 wherein bonding material is a foam.

10. The floor of claim 9 wherein the bonding material is polyurethane.

11. The floor of claim 10 wherein the wear surface is formed from metal.

12. The floor of claim 11 wherein the wear surface is formed from aluminum.

13. The floor of claim 12 wherein the support material is formed from a metal grid.

14. The floor of claim 13 wherein the support material is formed from an expanded and flattened metal.

15. The floor of claim 14 wherein the support material is formed from expanded steel.

16. A walk-in refrigerator/freezer comprising:

a) a plurality of insulated walls and an insulated ceiling;

b) an insulated door; and c) a floor having a top wear surface, a metal support grid beneath the top wear surface having a plurality of apertures and an insulation layer beneath the metal grid, the insulation layer formed from a foam material passing through the apertures of the metal grid and bonding to the wear surface.

17. The walk-in refrigerator/freezer of claim 16 wherein the support grid is formed from expanded steel.

18. The walk-in refrigerator/freezer of claim 17 wherein an interior storage space is defined for use with food.

19. The walk-in refrigerator/freezer of claim 16 wherein an interior storage space is defined for use with flowers or other perishables.

20. The walk-in refrigerator/freezer of claim 16 wherein a wear surface is formed from aluminum.

* * * * *